US008303006B2

(12) United States Patent
Wall

(10) Patent No.: US 8,303,006 B2
(45) Date of Patent: Nov. 6, 2012

(54) APPARATUS FOR GRIPPING AND LIFTING CONSTRUCTION CASTINGS

(76) Inventor: Erwin Wall, Jordan Station (CA)

( * ) Notice: Subject to any disclaimer, the term of this patent is extended or adjusted under 35 U.S.C. 154(b) by 104 days.

(21) Appl. No.: 12/927,991

(22) Filed: Dec. 1, 2010

(65) Prior Publication Data

US 2012/0098285 A1 Apr. 26, 2012

(30) Foreign Application Priority Data

Oct. 25, 2010 (CA) ..... 2718785

(51) Int. Cl.
*B66C 1/42* (2006.01)

(52) U.S. Cl. ..... 294/110.1; 294/115

(58) Field of Classification Search ..... 294/63.1, 294/81.51, 67.31, 110.1, 110.2, 115, 118
See application file for complete search history.

(56) References Cited

U.S. PATENT DOCUMENTS

| | | | | | |
|---|---|---|---|---|---|
| 255,546 | A | * | 3/1882 | Stephens | 294/4 |
| 1,216,291 | A | * | 2/1917 | Diescher | 294/67.31 |
| 2,337,177 | A | | 12/1943 | Breslav | |
| 2,382,227 | A | * | 8/1945 | Hopkins et al. | 294/110.1 |
| 2,382,626 | A | | 8/1945 | Gaston, Jr. et al. | |
| 2,629,627 | A | * | 2/1953 | Stone | 294/110.1 |
| 2,745,695 | A | | 5/1956 | Peyer | |
| 2,951,725 | A | | 9/1960 | St. Jean | |
| 3,051,521 | A | * | 8/1962 | Skowron | 294/110.1 |
| 3,297,353 | A | | 1/1967 | Carlson | |
| 3,451,711 | A | * | 6/1969 | Carpenter | 294/113 |
| 3,549,192 | A | * | 12/1970 | Cassady | 294/106 |
| 3,674,302 | A | | 7/1972 | Mutch | |
| 4,262,952 | A | | 4/1981 | Bradley | |
| 5,755,476 | A | | 5/1998 | Hosking | |
| 6,325,434 | B1 | | 12/2001 | Takao et al. | |
| 6,331,025 | B1 | | 12/2001 | Douglas | |
| 6,568,731 | B2 | | 5/2003 | Alexander, III et al. | |

* cited by examiner

*Primary Examiner* — Dean Kramer
(74) *Attorney, Agent, or Firm* — Hudak, Shunk & Farine LPA

(57) ABSTRACT

An apparatus for gripping and lifting objects such as construction castings has a T-shaped frame comprising elongate horizontal and vertical frame members. The vertical frame member is slidably received in one end of a hollow sleeve member which is connected to its upper end to a loop or hook. A pair of articulated pivot arms are each connected at one end to the hollow sleeve member and at the other end to the horizontal frame member, with a joint being provided between the ends of each pivot arm. Carried at the ends of the horizontal frame member are a plurality of contact members which are adapted to contact and grip the sidewall of a construction casting. In use, the apparatus is placed over a construction casting with the horizontal frame member resting on the upper surface and with the contact elements in position facing the side wall of the casting. The apparatus is then lifted, for example by a backhoe or loader, which causes the sleeve member to slide upwardly along the vertical frame member. This causes the pivot arms to lift, and brings about an inward and upward pivoting movement of the contact elements, causing them to engage and grip the side wall of the casting. The gripping force increases with the weight of the casting.

15 Claims, 6 Drawing Sheets

APPARATUS FOR GRIPPING AND LIFTING CONSTRUCTION CASTINGS

FIELD OF THE INVENTION

The invention relates to an apparatus for gripping and lifting construction castings.

BACKGROUND OF THE INVENTION

Large numbers of metal castings are used in the building of roads. Such castings typically comprise a flat cover which will be visible from the surface of the finished road, as well as a frame having a substantially vertical side wall and an enlarged base flange. The base flange and side wall are substantially completely covered during construction of the road, leaving the upper surface of the cover substantially flush with the finished road surface. Examples of typical construction castings used in road construction are frame and cover units for catch basins, which provide access to drains, and frame and cover units for maintenance holes. Catch basin frames and covers are usually square or rectangular, and maintenance hole frames and covers are usually circular. Catch basin and maintenance hole castings may weigh about 400-500 pounds.

During road construction, the castings must be moved into position. This is typically accomplished by machinery such as a forklift or backhoe/loader, and may be assisted manually. However, such machinery is not well adapted for lifting and moving construction castings, with the result that moving the castings around a construction site can be inconvenient, time consuming and can involve excessive amounts of manual labour. Due to the weight of the castings, manual handling of construction castings brings with it the risk of personal injury.

There is therefore a need for a device which will improve the handling of construction castings on a construction site, and particularly those which will minimize manual handling of castings.

SUMMARY OF THE INVENTION

In one embodiment, there is provided an apparatus for gripping and lifting an object. The apparatus comprises a T-shaped frame, a hollow sleeve member, first and second articulated pivot arms and at least one contact element. The T-shaped frame comprises a first elongate frame member having first and second ends and a second elongate frame member having first and second ends, wherein the first end of the first elongate frame member is rigidly secured to the second frame member between the first and second ends thereof. The hollow sleeve member has a first end and a second end, at least the first end being open, wherein the second end of the first frame member is slidably received inside the first end of the hollow sleeve member, and wherein the second end of the hollow sleeve member is adapted for connection to a lifting device. Each of the first and second articulated pivot arms comprises a first segment and a second segment pivotably connected together at a joint, wherein each of the pivot arms has a first end pivotably connected to the sleeve and a second end pivotably connected to the second frame member. The at least one contact element is provided at the second end of each of the pivot arms for contacting said object.

In an embodiment, the first end of the first elongate frame member is rigidly secured to the second frame member approximately midway between the first and second ends thereof.

In an embodiment, the sleeve has a front face and an opposed rear face, and wherein the first end of one of said pivot arms is pivotably connected to the front face, and wherein the first end of the other one of the pivot arms is pivotably connected to the rear face.

In an embodiment, each of the pivot arms is substantially coplanar with the T-shaped frame.

In an embodiment, the second segment of each of the pivot arms is longer than the first segment.

In an embodiment, the second segment of each of the pivot arms has a length which is more than one half the length of the second elongate frame member.

In an embodiment, for each of the articulated pivot arms, the joint and the second end of the pivot arm are located on opposite sides of the first elongate frame member.

In an embodiment, the second segment of each of the pivot arms is pivotable relative to the second elongate frame member by an angle of from 0 to about 30 degrees.

In an embodiment, the second end of each of the pivot arms is provided with an extension piece which is arranged at a substantially right angle to the second segment of the pivot arm, and wherein the contact elements are mounted at a lower end of the extension piece, such that they are spaced from the second elongate frame member.

In an embodiment, the contact elements are mounted to a pair of arms, each of which is mounted at a substantially right angle to the lower end of one of the extension pieces.

In an embodiment, the contact elements mounted to the arms are facing one another when the arms are parallel to one another.

In an embodiment, the contact elements comprise a plurality of pointed teeth.

In an embodiment, the second end of the hollow sleeve member is provided with a hook or a loop for connection to a lifting device.

BRIEF DESCRIPTION OF THE DRAWINGS

The invention will now be described, by way of example only, with reference to the accompanying drawings in which.

DETAILED DESCRIPTION

Figure 1:
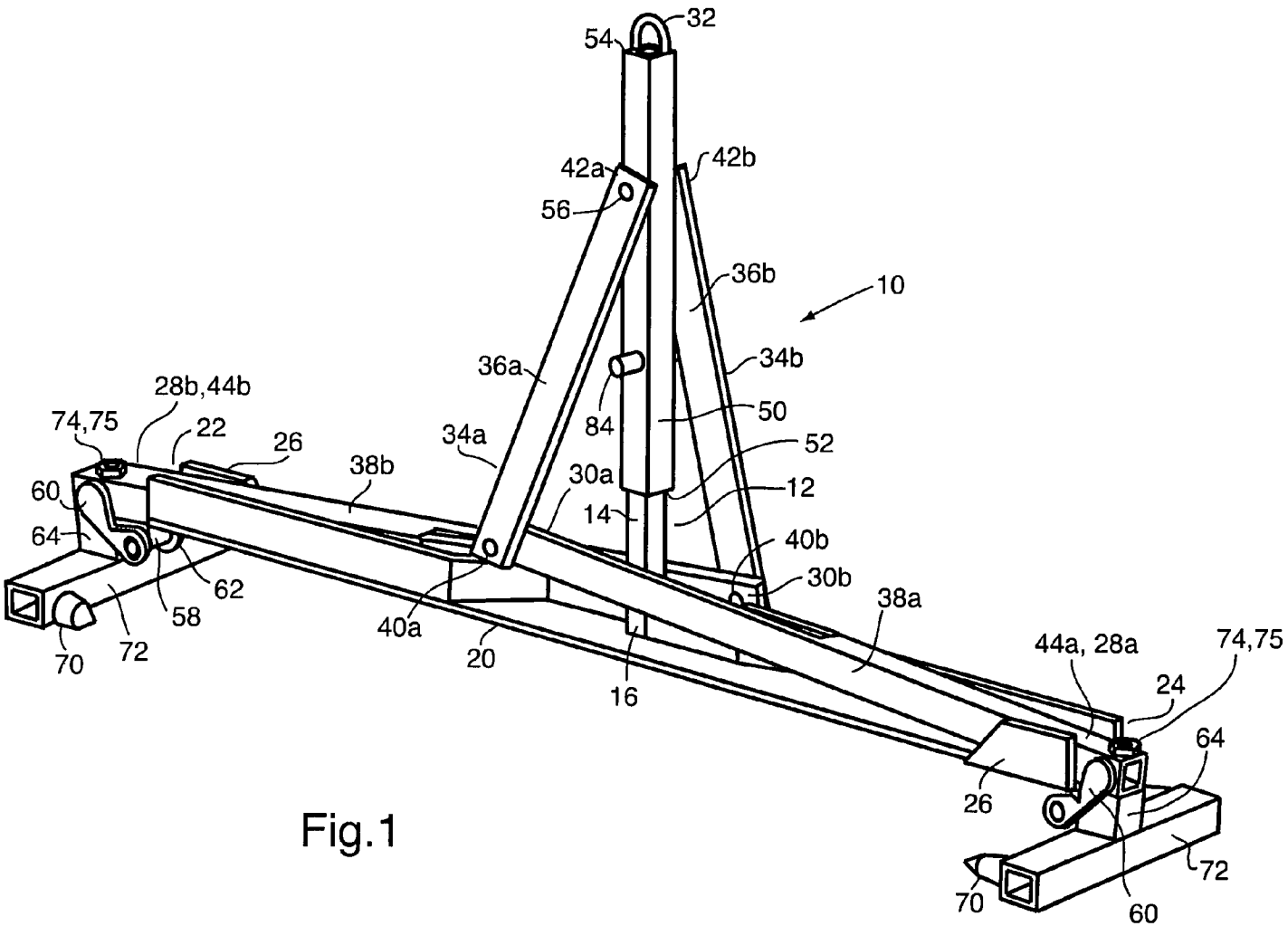
FIG. 1 is a front perspective view of an apparatus according to an embodiment of the invention.
Figure 2:
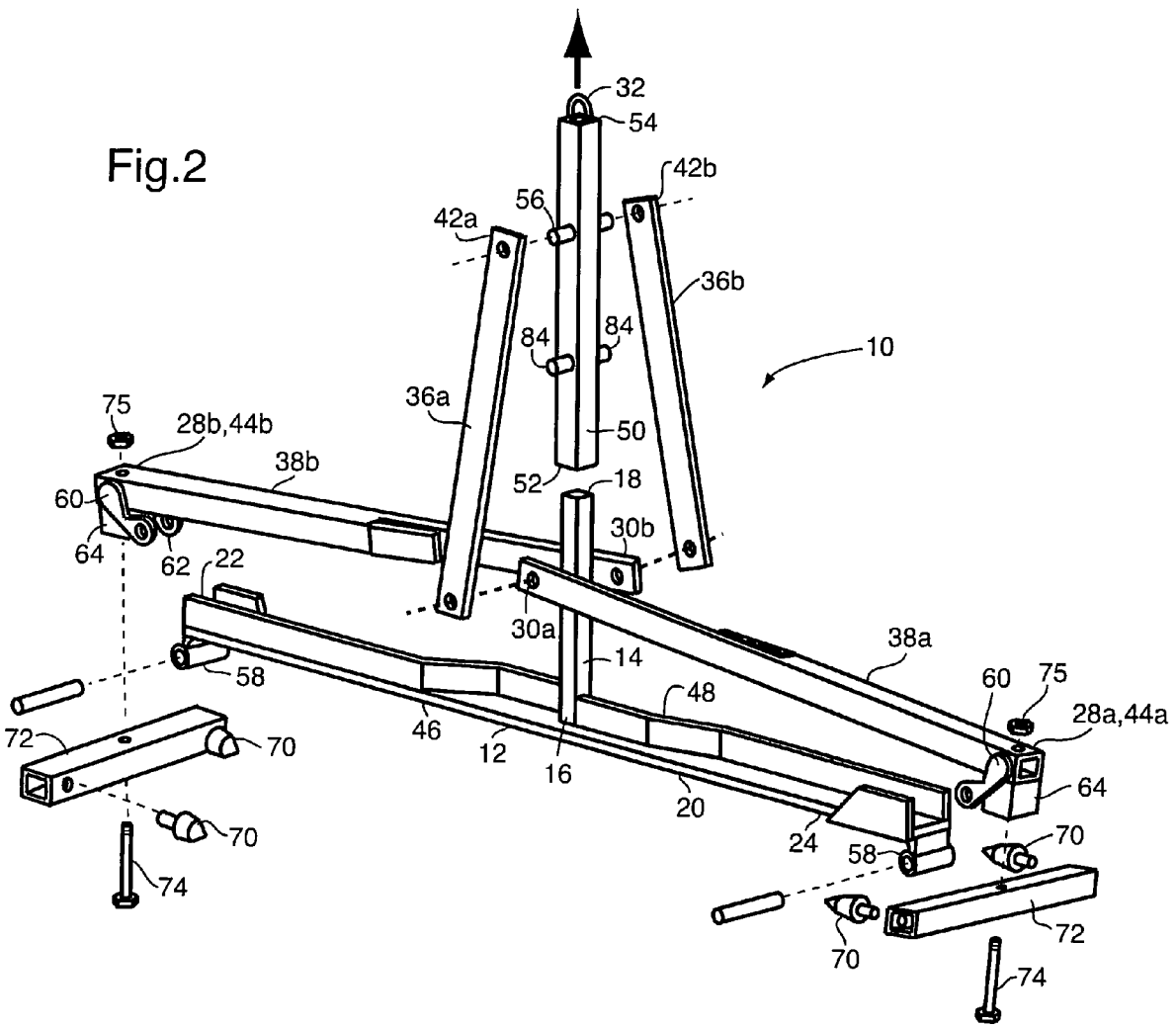
FIG. 2 is an exploded front perspective view of the apparatus of FIG. 1.

Throughout the following description and claims, terms such as "vertical", "horizontal", "top", "bottom", "upper", "lower", "front", "rear" and the like may be used to describe various parts of the apparatus according to the invention. These terms of reference are used for convenience only, and are generally consistent with the orientation of the apparatus as it is shown in the drawings.

An apparatus 10 according to an embodiment of the invention is illustrated in FIGS. 1 to 7. Apparatus 10 includes a T-shaped frame 12 comprising a first elongate frame member 14 (also referred to herein as the "vertical frame member") having first and second ends 16, 18, and a second elongate frame member 20 (also referred to herein as the "horizontal frame member") having first and second ends 22, 24. The first end 16 of vertical frame member 14 is rigidly secured to the horizontal frame member 20 midway between its first and second ends 22, 24, this midway point being coincident with the center of gravity of the horizontal member 20. The vertical and horizontal frame members 14, 20 are coplanar with one another and are secured together, for example by welding, at an angle of about 90 degrees.

The vertical frame member 14 may comprise tubular steel or a solid steel bar of any suitable cross-sectional shape, such as the rectangular or square cross-section shown in the drawings. The horizontal frame member 20 is preferably constructed from sections of steel angle, tubular steel, or from steel plates which are welded together to form angles or tubular structures, such that the horizontal frame member 20 is sufficiently rigid to withstand heavy loads without bending. The horizontal frame member 20 illustrated in the drawings may be constructed by welding together pieces of steel plate such that it has a L-shaped, T-shaped or U-shaped cross-section at any point along substantially its entire length. This example of the horizontal frame member 20 comprises a flat horizontal plate 46 and a vertical plate 48 which are welded together at an angle of about 90 degrees. The vertical plate 48 is interrupted by vertical frame member 14 and diagonally traverses the horizontal plate 46 so that it extends along opposite edges of the horizontal plate 46 as it approaches the opposite ends 22, 24 of the horizontal frame member 20. The ends 22, 24 of horizontal frame member may further be reinforced by providing supplemental vertical plates 26 proximate the ends 22, 24, so as to provide the horizontal frame member 20 with a U-shaped cross section proximate its ends 22, 24.

The apparatus 10 further comprises a hollow sleeve member 50 having a first end 52 and a second end 54. At least the first end 52 of hollow sleeve member 50 is open and is adapted to slidably receive the second end 18 of vertical frame member 14. The hollow sleeve member 50 may comprise a length of hollow tubular steel having a cross section which is similar or identical in shape than that of the vertical frame member 14, the cross section of the sleeve member 50 of course being somewhat larger so as to permit the hollow sleeve member 50 to freely slide up and down along the vertical frame member 14. In the illustrated embodiment, the hollow sleeve member 50 comprises a length of hollow tubular steel having a square or rectangular cross section.

The second end 54 of the hollow sleeve member 50 is adapted for connection to a lifting device, as further described below. For example, a steel loop 32 may be welded to the second end 54 of hollow sleeve member 50, although alternate means of connection are within the scope of the invention. For example, the loop 32 may be replaced by a hook or a chain.

The apparatus 10 further comprises a pair of articulated pivot arms 34. In order to distinguish the two pivot arms of apparatus 10, the pivot arm extending along the front face of the vertical frame member 14 is identified in the drawings by reference numeral 34*a*, and the pivot arm extending along the rear face of the vertical frame member 14 is identified in the drawings by reference numeral 34*b*. The various components of pivot arms 34*a* and 34*b* are likewise distinguished from one another in the drawings.

Each pivot arm 34 comprises a first segment 36 and a second segment 38 which are pivotably connected together at a joint 40. The first segment 36 comprises a flat, elongate steel plate provided with apertures close to both of its ends. The second segment 38 is longer than the first segment 36 and is of variable cross-section, having one end 28 with a rectangular or square cross section and the opposite end 30 being flat and provided with an aperture for connection to the first segment 36. The joint 40 may simply be formed by securing a pin or a bolt through the apertures in the first and second segments 36 and 38 of pivot arm 34. It will be appreciated that the pivot arms 34 need not be constructed exactly as shown in the drawings. For example, it is possible for the first and/or second segment 36, 38 of each pivot arm 34 to be constructed entirely from tubular steel.

A first end 42 of each pivot arm 34, which is coincident with an apertured end of first segment 36, is pivotably connected to the hollow sleeve member 50, proximate to the second end 54 thereof. For example, pivot arms 34*a*, 34*b* may be secured to the front and rear faces of hollow sleeve member 50 by providing sleeve member 50 with a through aperture and securing the articulated pivot arms 34*a*, 34*b* by means of a pin 56 or bolt passing through the aperture and through the apertures at the first ends 42*a*, 42*b* of the articulated pivot arms 34*a*, 34*b*.

A second end 44 of each pivot arm 34, which is coincident with the rectangular or square sectioned end 28 of second segment 38, is pivotably connected to the horizontal frame member 20 proximate one of its ends 22 or 24. This pivoting connection is best explained by reference to the exploded view of FIG. 2. As shown, the ends 22, 24 of the horizontal frame member 20 are provided with knuckles 58 which are secured to the undersides of the horizontal plate member 46, for example by welding. The knuckles 58 comprise hollow tubular members of circular cross-section. Also, the second end 44 of each pivot arm 34 is provided with brackets 60, 62, each having one end rigidly secured to the front or rear face of the second end 44 of pivot arm 34, and an opposite end projecting inwardly and downwardly from the end 44 of pivot arm 34 toward one of the knuckles 58. The projecting end of each bracket 60, 62 is provided with an aperture to permit each pair of brackets 60, 62 to be pivotably secured to one of the knuckles 58 by a bolt or pin, thereby providing a pivoting connection between the second end 44 of each articulated pivot arm 34 and one of the ends 22 or 24 of the horizontal frame member 20.

The apparatus 10 further comprises a plurality of contact elements 70 adapted for engaging and gripping an object. The contact elements 70 are provided at the second ends 44 of the pivot arms 34. In the embodiment shown in the drawings, each of the pivot arms 34 is provided with an extension piece 64 which extends downwardly from the second segment 38 of pivot arm 34. The extension piece 64 comprises an open-ended tubular member with a hollow interior, and may be of the same cross-sectional shape and size as the second end 44 of the articulated pivot arm 34. The upper end of each extension piece 64 is rigidly secured to the lower surface of a pivot arm 34, for example by welding, at an angle of about 90 degrees.

Figure 6A:
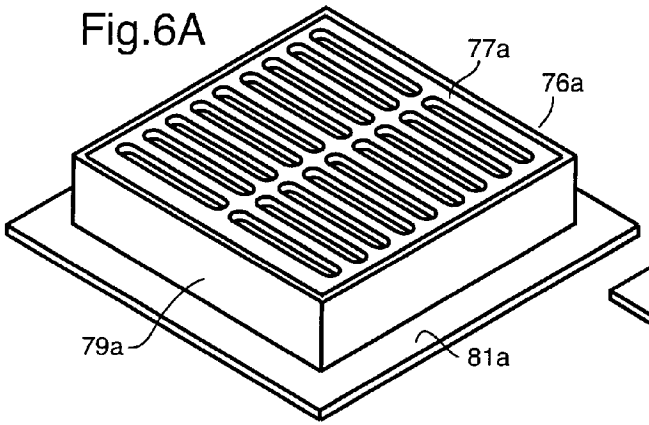
FIG. 6A shows a rectangular catch basin frame and cover and FIG. 6B shows the positioning of the contact elements of the apparatus of FIG. 1 relative to the frame of the casting of FIG. 6A, during lifting and moving of the casting.
Figure 7B:
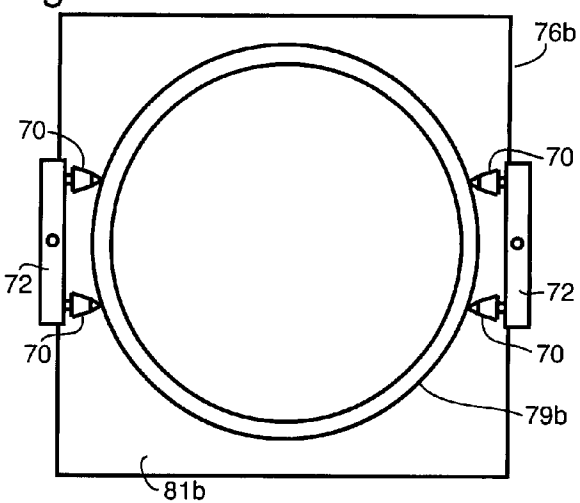
Figure 6B:
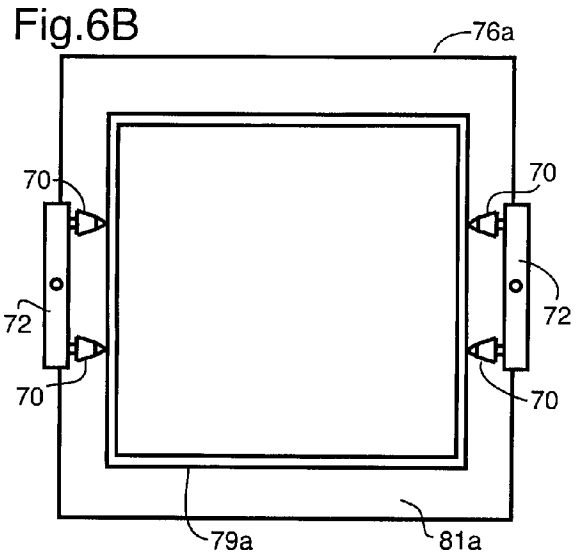

Each extension piece 64 has a lower end which carries a mounting arm 72 to which the contact elements 70 are mounted. The mounting arms 72 may comprise hollow tubular steel members of similar cross sectional size and shape as the second ends 44 of pivot arms 34 and the extension pieces 64, but this is not necessary. Each mounting arm 72 is apertured through its upper and lower surfaces about midway between its ends for connection to the second end 44 of a pivot arm 34, by a bolt 74 and nut 75, although a pin may be used instead. The bolt 74 extends through the aligned apertures in the mounting arm 72, through the hollow interior of extension piece 64, and through a pair of aligned apertures in the second end 44 of articulated pivot arm 34. Thus, each of the arms 72 is rotatable about an axis extending through the extension piece 64. In the illustrated embodiment, the axis of rotation is substantially vertically oriented such that the rotation of the arms 72 is from side-to-side. The angle through which the arms 72 are able to rotate need not be limited, but at least a small amount of rotation is desirable in order to assist with aligning the arms 72 relative to a casting, which may have a somewhat uneven surface, and to provide for equalization of pressure applied by the contact elements 70 on the side wall 79 of the casting 76 during lifting. For example, the arms 72 may be rotatable about an axis extending through the extension piece by an angle of about 10 degrees, in both directions relative to an angle of zero degrees, which is achieved when the two arms 72 are parallel to one another as shown in FIGS. 6B and 7B. Limiting the amount of side-to-side rotation helps to minimize the amount of manual assistance needed to align the contact elements 70 relative to the side wall 79 of casting 76, and also help to keep the apparatus 10 compact and able to lift castings 76 in confined spaces.

Pointed contact elements 70 are located proximate to the ends of the mounting arms 72, and may be secured to the mounting arms by pins, bolts and/or weld joints. The contact elements 70 are arranged to project from one of the side surfaces of each mounting arm 72. The contact elements 70 are pointed and may be cone or wedge-shaped. Also, the contact elements 70 may be made from steel which is harder than the castings and may, for example, comprise points for a grinding machine.

The use of apparatus 10 for gripping and lifting construction castings 76 is now described below. In the following description, the apparatus 10 is suspended from a lifting device, such as the bucket 80 of a backhoe/loader 82, by a chain 78. The device 10 is used to lift and move construction castings 76 of the type having a flat, substantially horizontal upper surface 77 and a substantially vertical side wall 79, such as circular maintenance hole covers and frames, or rectangular catch basin covers and frames. The castings 76 may also include a flat base flange 81. Although the side wall 79 of the casting 76 may be at an angle of 90 degrees relative to the base flange 81 and the upper surface 77, it will be appreciated that the side wall 79 of the casting 76 may taper somewhat between the base flange 81 and the upper surface 77. For example, the side wall 79 may have an inward taper from the base flange 81 to the upper surface 77.

Figure 3:
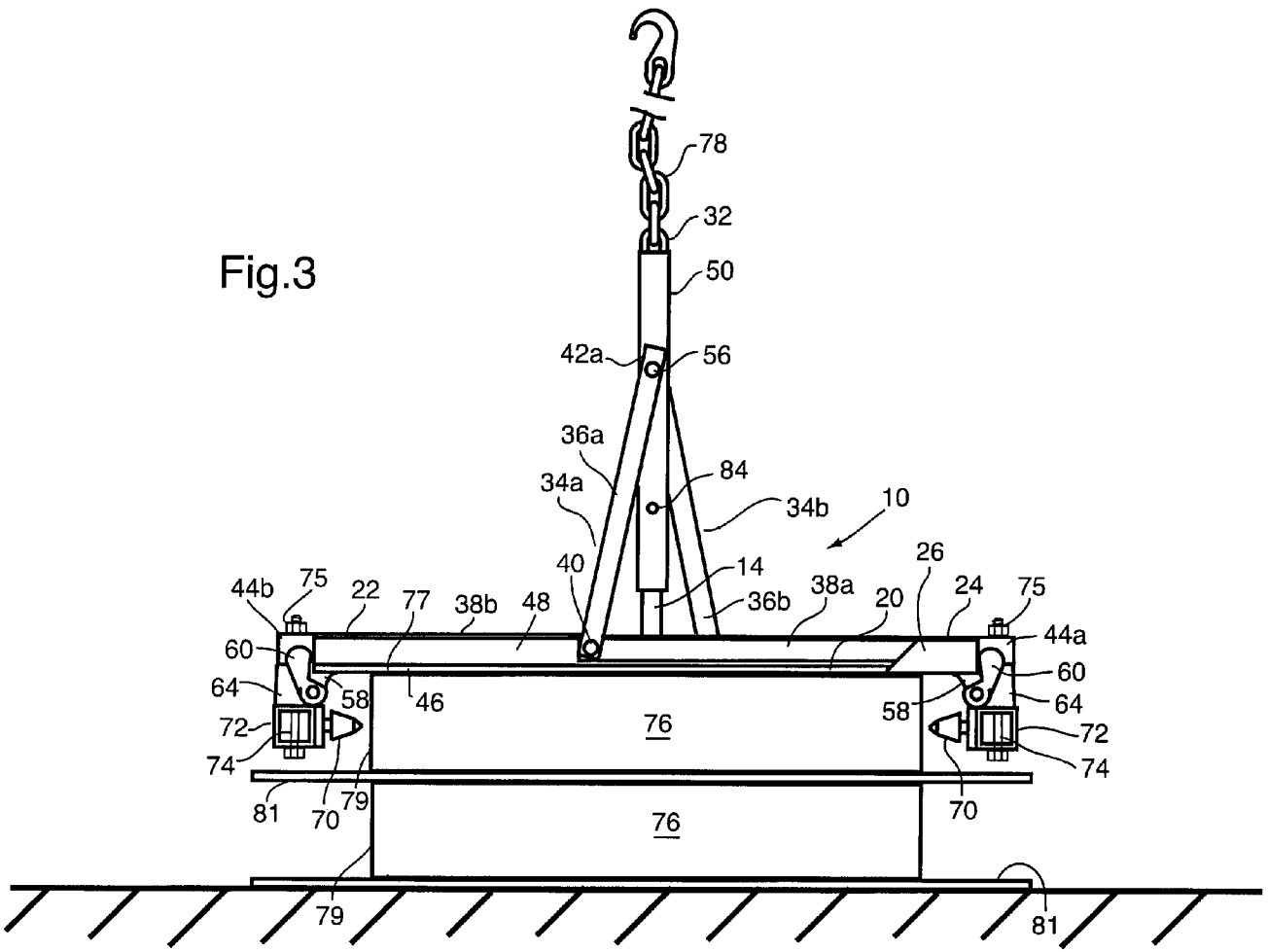
FIG. 3 is a front plan view of the apparatus of FIG. 1 as it is being brought into position relative to a casting.

In order to engage a construction casting 76, the apparatus 10 is brought to rest on the flat upper surface 77 of the casting 76, optionally with manual assistance, and the pivot arms 34 and sleeve member 50 are allowed to drop to the rest position, for example by creating slack in the chain 78, as shown in FIG. 3. As the apparatus 10 is lowered into position, the mounting arms 72 are manually rotated, if necessary, so as to bring the contact elements 70 into facing relationship to one another and with the side wall 79 of casting 76.

It can be seen from FIG. 3 that the various components of apparatus 10 are adapted to allow apparatus 10 to grip and lift specific types of wide, relatively flat construction castings 76. For example, the horizontal frame member has a length which is somewhat greater than a side-to-side dimension of the construction casting 76. Therefore, the second ends 44 of the pivot arms 34, the extension pieces 64, mounting arms 72 and contact elements are located close to the side wall 79 of the casting 76 in the rest position. Also, extension pieces 64 are of sufficient length such that the contact elements 70 are positioned alongside the side wall 79 of the casting 76 when the horizontal frame member 20 comes to rest on the upper surface 77 of the casting 76. It will be appreciated that the dimensions of apparatus 10 can be adapted for use with castings of various dimensions.

In the rest position, the angle between the second segment 38 of each pivot arm 34 and the horizontal frame member 20, measured about the pivot joint at knuckle 58, is at a minimum. For example, as shown in FIG. 3, the second segment 38 of each pivot arm 34 may be at an angle of 0° relative to the horizontal frame member 20, such that the second segment 38 is in contact with the horizontal frame member 20 and is nested with the vertical plate member 48 thereof. Although this nesting is not necessary for functioning of the apparatus, it provides the apparatus 10 with a low (flat) profile, thereby making it more convenient to transport and store. In the rest position the hollow sleeve member 50 is at its lowermost position relative to the frame 12. Also, it will be appreciated that the angle between horizontal member 20 and second segment 38 of pivot arm 34 can be greater than 0° in the rest position.

In the rest position, the points of contact elements 70 are inclined at an angle of about 0° relative to a horizontal plane and relative to the horizontal frame member 20. Also in the rest position, the angle between the first segment 36 of each pivot arm 34 and the hollow sleeve member 50, measured about the pivot joint at 56, is at a maximum.

Figure 4:
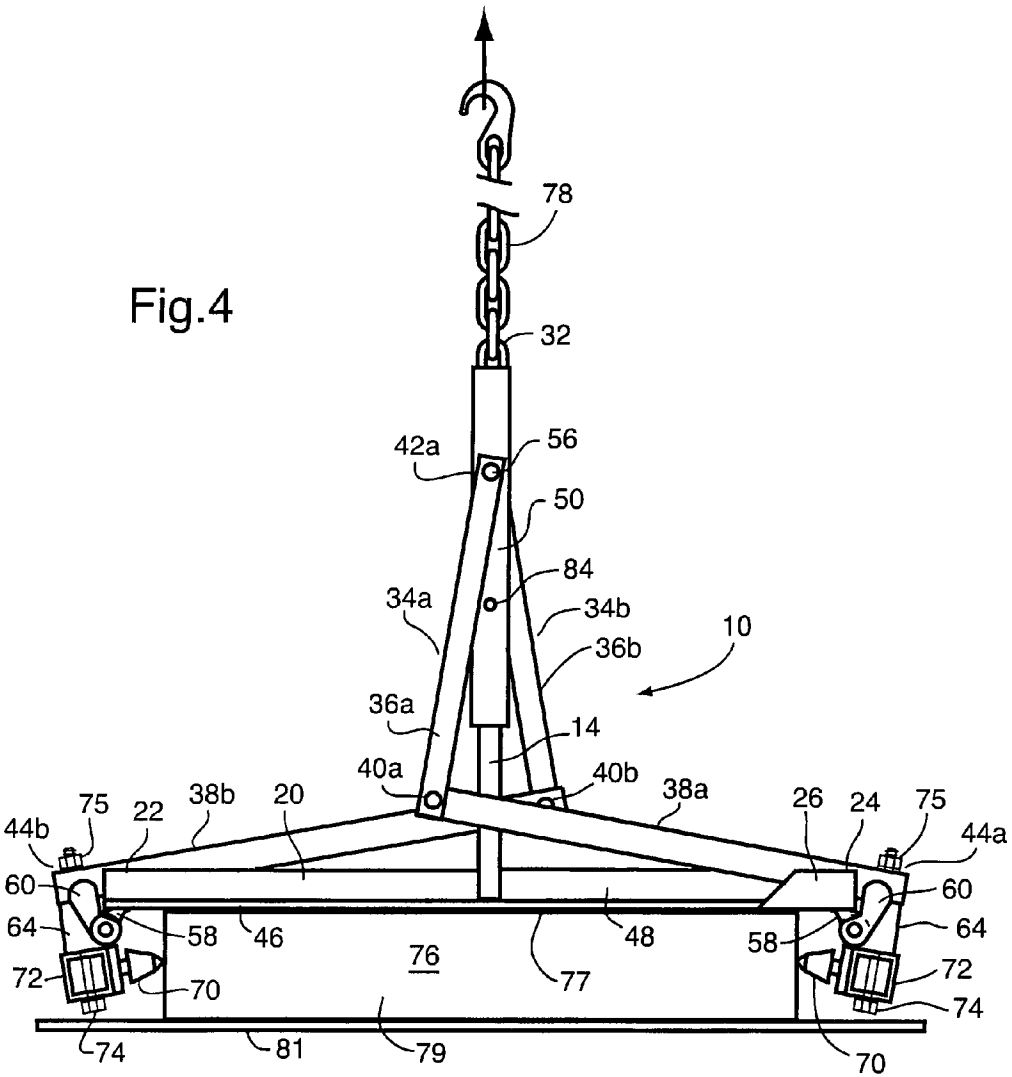
FIG. 4 is a front plan view of the apparatus of FIG. 1 as it is lifting and moving a casting.
Figure 5:
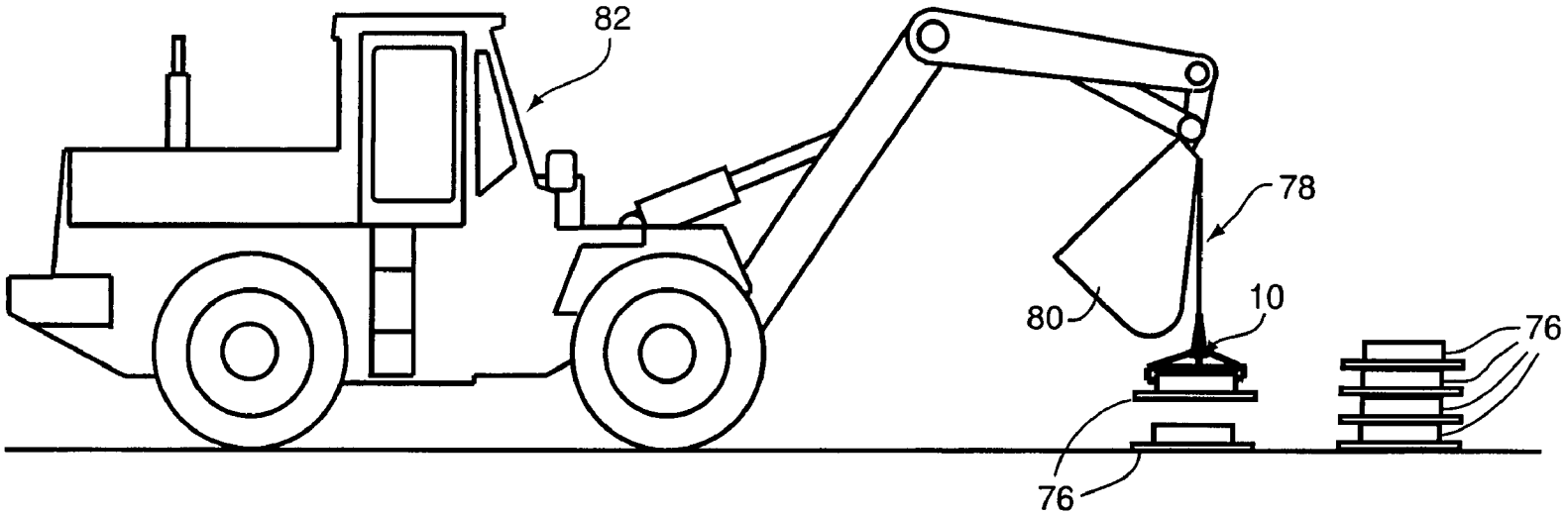
FIG. 5 shows a backhoe/loader lifting a casting with the assistance of the apparatus of FIG. 1.
Figure 7A:
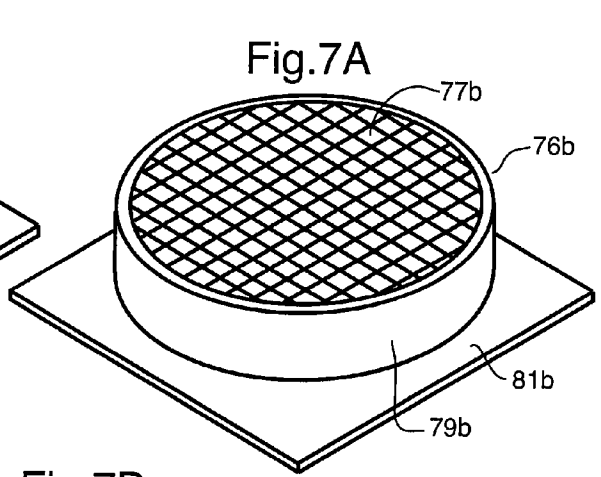
FIG. 7A shows a circular maintenance hole frame and cover and FIG. 7B shows the positioning of the contact elements of the apparatus of FIG. 1 relative to the frame of the casting of FIG. 7A, during lifting and moving of the casting.

Once the apparatus 10 is brought to the rest position shown in FIG. 3, the lifting device pulls upwardly on chain 78, thereby pulling upwardly on sleeve member 50 and causing it to slide upwardly along the vertical frame member 14. The upward displacement of sleeve member 50 causes a corresponding upward displacement of the first end 42 of each pivot arm 34, which in turn lifts the flat end 30 of each second segment 38 away from an end 22 or 24 of the horizontal frame member 20. This causes pivoting of the second segment 38 about knuckle 58, increasing the angle between horizontal member 20 and the second segment 38 of pivot arm 34, bringing the contact elements 70 of the respective rotating arms 72 closer together until the points of the contact elements 70 are brought into engagement with opposite side walls 79 of the casting 76, as shown in FIG. 4 which illustrates the active or engaged position of apparatus 10.

With the apparatus 10 in the active position, the contact elements 70 are slightly inclined relative to a horizontal plane and relative to the horizontal frame member 20. This enhances the inwardly directed forces exerted by the contact elements 70 on the side wall 79 of the casting 76, which are sufficiently strong such that the castings can be securely lifted and moved when the apparatus is in the engaged position as shown in FIG. 4. In the active position, the angle between horizontal member 20 and second segment 38 of pivot arm 34 is increased by about 10-30 degrees, for example from about 15-25 degrees, relative to the angle in the rest position. For example, where the angle between horizontal member 20 and second segment 38 of pivot arm 34 in the rest position is 0°, it will be about 10-30 degrees, for example from about 15-25 degrees, in the active position. Since the extension pieces 64, mounting arms 72 and contact elements 70 depend from the second segment 38 of pivot arm 34, the pivoting movement of the second segment 38 results in a corresponding upward inclination of the contact elements 70 by a similar amount, i.e. by about 10-30 degrees, for example from about 15-25 degrees, relative to a horizontal plane and relative to the horizontal frame member 20. The upward pivoting of the contact elements 70 provides for a strong grip on the casting 76 during lifting.

In the active position, the angle between the first segment 36 of each pivot arm 34 and the hollow sleeve member 50, measured about the pivot joint at 56, is at a minimum. Typically, this minimum angle is greater than zero degrees, and further inward movement of the first segments 36 of pivot arms 34 is by a significant amount beyond this point is limited by the presence of pins 84 projecting from the front and rear faces of the sleeve member 50. The pins 84 act as stops which will prevent excessive upward displacement of the sleeve member 50 when the apparatus 10 is not in engagement with a casting 76, but are not in contact with the first segments 36 of pivot arms 34 in the active position shown in FIG. 4.

It will be appreciated that the length of the second segment 38 of each pivot arm 34 relative to the length of the extension piece 64 is such that a strong compressive force will be generated by the contact elements. Therefore, as shown in the drawings, the second segment 38 of each pivot arm 34 is considerably longer than the extension pieces 64, and has a length which is more than half the length of the horizontal frame member 20.

Once the casting 76 is transported to its desired location by backhoe/loader 82, it is released simply by lowering the casting to the ground such that slack is created in the chain and the points of contact elements 70 are disengaged from the side wall 79 of the casting 76. This can be done without manual assistance. Although manual assistance may be required for initial engagement of the casting, at no point during the lifting and moving process is there a need for the casting to be manually lifted.

By the use of four-point contact, and by locating the contact elements 70 close to the ends of the mounting arms 72, the apparatus according to the invention is configured for gripping and lifting construction castings of various dimensions. For example, as shown in FIGS. 6A and 6B, the four-point contact is provided by locating two contact elements 70 on each arm 72. Furthermore, the contact elements 70 may be located near the ends of arms 72. This four-point contact allows for secure lifting of square or rectangular castings 76*a*, such as frame and cover units for catch basins and circular castings 76*b* such as frame and cover units for maintenance holes. The inventor has found that the four-point contact provides a strong grip on castings of various dimensions, and resists slipping even on castings having tapering or uneven side walls, and on castings which are wet.

It can be seen that the frictional, or gripping, force exerted on the casting side wall 79 by the contact elements 70 is dependent on the force exerted on the hollow sleeve member 50 during lifting. That is, the inward force exerted by the contact elements 70 increases as the lifting force is increased. Therefore, the strength of the gripping force is proportional to the weight of the casting, resulting in secure lifting whether the operator is lifting a single casting or a group of castings bound together in a stack. This variable gripping force is provided through the use of a simple T-shaped frame with a vertical frame member 14 and hollow sleeve 50 to which the pivot arms 34 are secured, and may not be provided to the same degree by lifting tongs or the like having a scissor-type arrangement.

Although the invention has been described in connection with certain preferred embodiments, it is not restricted thereto. Rather, the invention includes all embodiments which may fall within the scope of the following claims.

What is claimed is:

1. An apparatus for gripping and lifting an object, comprising:

(a) a T-shaped frame comprising a first elongate frame member having first and second ends and a second elongate frame member having first and second ends, wherein the first end of the first elongate frame member is rigidly secured to the second frame member between the first and second ends thereof;

(b) a hollow sleeve member having a first end and a second end, at least the first end being open, wherein the second end of the first frame member is slidably received inside the first end of the hollow sleeve member, and wherein the second end of the hollow sleeve member is adapted for connection to a lifting device;

(c) first and second articulated pivot arms, each of the pivot arms comprising a first segment and a second segment pivotably connected together at a joint, wherein each of the pivot arms has a first end pivotably connected to the sleeve and a second end pivotably connected to the second frame member;

(d) at least one contact element provided at the second end of each of the pivot arms for contacting said object; and wherein the sleeve has a front face and an opposed rear face, and wherein the first end of one of said pivot arms is pivotably connected to the front face, and wherein the first end of the other one of the pivot arms is pivotably connected to the rear face.

2. The apparatus according to claim 1, wherein the first end of the first elongate frame member is rigidly secured to the second frame member approximately midway between the first and second ends thereof.

3. The apparatus according to claim 1, wherein each of the pivot arms is substantially coplanar with the T-shaped frame.

4. The apparatus according to claim 1, wherein the second segment of each of the pivot arms is longer than the first segment.

5. The apparatus according to claim 1, wherein the second segment of each of the pivot arms has a length which is more than one half the length of the second elongate frame member.

6. The apparatus according to claim wherein, for each of the articulated pivot arms, the joint and the second end of the pivot arm are located on opposite sides of the first elongate frame member.

7. The apparatus according to claim 1, wherein the second segment of each of the pivot arms is pivotable relative to the second elongate frame member by an angle of from 0 to about 30 degrees.

8. The apparatus according to claim 1, wherein the second end of the hollow sleeve member is provided with a hook or a loop for connection to a lifting device.

9. An apparatus for gripping and lifting an object, comprising:

(a) a T-shaped frame comprising a first elongate frame member having first and second ends and a second elongate frame member having first and second ends, wherein the first end of the first elongate frame member is rigidly secured to the second frame member between the first and second ends thereof;

(b) a hollow sleeve member having a first end and a second end, at least the first end being open, wherein the second end of the first frame member is slidably received inside the first end of the hollow sleeve member, and wherein the second end of the hollow sleeve member is adapted for connection to a lifting device;

(c) first and second articulated pivot arms, each of the pivot arms comprising a first segment and a second segment pivotally connected together at a joint, wherein each of the pivot arms has a first end pivotably connected to the sleeve and a second end pivotably connected to the second frame member;

(d) at least one contact element provided at the second end of each of the pivot arms for contacting said object; and wherein the second end of each of the pivot arms is provided with an extension piece which is arranged at a substantially right angle to the second segment of the pivot arm, and wherein the contact elements are mounted at a lower end of the extension piece, such that they are spaced from the second elongate frame member.

10. The apparatus according to claim 9, wherein the contact elements are mounted to a pair of mounting arms, each of which is mounted at a substantially right angle to the lower end of one of the extension pieces.

11. The apparatus according to claim 10 wherein the contact elements mounted to the mounting arms are facing one another when the arms are parallel to one another.

12. The apparatus according to claim 11, wherein the contact elements comprise a plurality of pointed teeth.

13. The apparatus according to claim 12, wherein the contact elements provide four-point contact with the sidewall of a casting when the apparatus is in use.

14. The apparatus according to claim 13, wherein the four-point contact is provided by four contact elements, two on each of the mounting arms.

15. The apparatus according to claim 14, wherein the contact elements are each mounted proximate to an end of one of the mounting arms.

* * * * *

UNITED STATES PATENT AND TRADEMARK OFFICE

CERTIFICATE OF CORRECTION

PATENT NO. : 8,303,006 B2
APPLICATION NO. : 12/927991
DATED : November 6, 2012
INVENTOR(S) : Erwin Wall It is certified that error appears in the above-identified patent and that said Letters Patent is hereby corrected as shown below:

In the Claims

In Column 8, line 40, Claim 6 After "according to claim" a --1-- should be inserted.

In Column 8, line 67, Claim 9 the first word "pivotally" was misspelled and should be "pivotably".

Signed and Sealed this
Second Day of July, 2013

Teresa Stanek Rea
*Acting Director of the United States Patent and Trademark Office*